US011796292B2

(12) United States Patent
Shen et al.

(10) Patent No.: US 11,796,292 B2
(45) Date of Patent: Oct. 24, 2023

(54) INTELLIGENT MULTI-ROTOR RESCUE THROWER AND CONTROL METHOD THEREOF

(71) Applicant: JIANGSU UNIVERSITY, Zhenjiang (CN)

(72) Inventors: Yue Shen, Zhenjiang (CN); Yicen Li, Zhenjiang (CN); Dewei Wang, Zhenjiang (CN); Xiuli Wang, Zhenjiang (CN); Zhixiang Shi, Zhenjiang (CN); Yayun Shen, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 0 days.

(21) Appl. No.: 17/927,902

(22) PCT Filed: Feb. 15, 2022

(86) PCT No.: PCT/CN2022/076340

§ 371 (c)(1),
(2) Date: Nov. 28, 2022

(87) PCT Pub. No.: WO2022/242248

PCT Pub. Date: Nov. 24, 2022

(65) Prior Publication Data

US 2023/0204331 A1 Jun. 29, 2023

(30) Foreign Application Priority Data

May 21, 2021 (CN) ..... 202110559078.7

(51) Int. Cl.
*F42B 10/58* (2006.01)
*F42B 10/56* (2006.01)
(Continued)

(52) U.S. Cl.
CPC ..... *F42B 10/58* (2013.01); *B63C 9/26* (2013.01); *F42B 10/56* (2013.01); *F42B 12/56* (2013.01)

(58) Field of Classification Search
CPC ..... F42B 10/56; F42B 10/58; F42B 10/60; F42B 10/62; F42B 10/66; F42B 12/56; F42B 12/58; F42B 15/01
See application file for complete search history.

(56) References Cited

U.S. PATENT DOCUMENTS 4,890,554 A * 1/1990 Schleimann-Jensen ..... F42B 10/62 244/3.21
6,347,764 B1 * 2/2002 Brandon ..... F42B 10/58 102/388
(Continued)

FOREIGN PATENT DOCUMENTS

CA 2469680 A1 7/2003
CN 106839901 A 6/2017
(Continued)

*Primary Examiner* — Gabriel J. Klein
(74) *Attorney, Agent, or Firm* — Bayramoglu Law Offices LLC

(57) ABSTRACT

In an intelligent multi-rotor rescue thrower, a throwing projectile head is located at a foremost end of the thrower, a parachute storage bin is mounted at a center of a front end of the throwing projectile head, a rear end of the throwing projectile head is connected to a projectile body shell through threads, and a first splitter plate, a second splitter plate, and a third splitter plate are directly connected to the projectile body shell through slide grooves built in the projectile body shell to equally divide a space in a cavity of the projectile body shell; connecting flanges tightly connect the projectile body shell to motors, a rotor is connected to an
(Continued)

upper end of each of the motors, and three rotors are provided in the space in the cavity of the projectile body shell.

6 Claims, 2 Drawing Sheets

(51) Int. Cl.
*F42B 12/56* (2006.01)
*B63C 9/26* (2006.01)

(56) References Cited

U.S. PATENT DOCUMENTS

| | | | | |
|---|---|---|---|---|
| 9,033,281 | B1 | 5/2015 | Adams | |
| 9,527,596 | B1 * | 12/2016 | Adams | B64C 39/024 |
| 2019/0077503 | A1 * | 3/2019 | Reddy | F42B 10/58 |
| 2021/0107645 | A1 * | 4/2021 | Izraelevitz | B64C 1/30 |
| 2022/0219814 | A1 * | 7/2022 | Benedict | B64U 80/70 |

FOREIGN PATENT DOCUMENTS

| | | | | |
|---|---|---|---|---|
| CN | 108196565 | A | 6/2018 | |
| CN | 108344334 | A | 7/2018 | |
| CN | 210618484 | U | 5/2020 | |
| CN | 212448021 | U | 2/2021 | |
| CN | 113353213 | A | 9/2021 | |
| KR | 101374307 | B1 * | 3/2014 | |
| WO | WO-2018190319 | A1 * | 10/2018 | B64C 39/024 |

* cited by examiner

INTELLIGENT MULTI-ROTOR RESCUE THROWER AND CONTROL METHOD THEREOF

CROSS REFERENCE TO THE RELATED APPLICATIONS

This application is the national phase entry of International Application No. PCT/CN2022/076.340, filed on Feb. 15, 2022, which is based upon and claims priority to Chinese Patent Application No. 202110559078.7, filed on May 21, 2021, the entire contents of which are incorporated herein by reference.

TECHNICAL FIELD

The present disclosure relates to the technical fields of rescue equipment automation and flight control, and in particular, to a multi-rotor controllable intelligent thrower for a fixed-point tracking purpose.

BACKGROUND

Irresistible geological disasters greatly threaten safety of people's lives and properties, and in special situations, such as flood fight and relief provision, marine rescue, or the like, there often exists a situation where persons are trapped and require emergency rescue, but the trapped persons are not easy to contact directly. In this case, a rescue environment is generally quite severe, a rescue opportunity is fleeting, and requirements for rescue conditions are high. Under general conditions, when a major disaster occurs, military and police forces are used for rescue, and can often successfully help the trapped persons get out of trouble due to professional lifesaving skills and rescue equipment. However, in some emergency situations, due to time required for arrival of large rescue equipment, portable rescue equipment has a faster and better effect. First, many disasters occur in an instant, such as an accidental water fall, ship distress, or the like, these dangerous accidents occur without warnings, but the trapped persons are required to be rescued in a quite short time once the accidents occur. If rescue is requested after a hazard occurs, the time when a rescue force arrives may be too late; for example, when a fire breaks out on a high floor, fire-fighting measures are difficult to act on an ignition point in a short time, and a small accident may cause a big disaster if the fire is allowed to develop; a thrower may carry a fire fighting bomb, and the fire may be fought as soon as the fire breaks out, so as to restrain the development of the fire. The thrower is such emergency rescue equipment, and when someone in accompanying persons encounters danger or has a dangerous case, the lifesaving thrower may be launched, and the thrower brings a swim ring, a life jacket, a fire fighting bomb, or other rescue equipment to the trapped person, so as to prevent the dangerous case and help the trapped person get out of trouble.

The thrower is a device which sends required equipment to a specified position with gunpowder, gas, or electromagnetic force as power according to a principle similar to bullet shoot. The thrower is mainly configured for emergency rescue, climbing anchor hooks, mountain-and-river-spanning wire stringing, counter-terrorism operations, and other scenarios, and is particularly applied to the field of emergency rescue. A rescue thrower technology originates in foreign countries, but after imported into China, the technology is developed continuously, a gap with foreign countries is also reduced gradually, and current general lifesaving requirements can be met. With improvement of a launching technology and a projectile body, the prior thrower may have a maximum throwing distance of 300 meters without a load, and an effective throwing distance of 200 meters with a load.

Currently, many offshore vessels, rescue teams, and beach facilities begin to be equipped with the lifesaving throwers. Currently, the thrower on the Chinese market is mainly launched with gas as power, and has a principle that enough high-pressure gas is stored in a gas storage bin firstly, and when the thrower is launched, the high-pressure gas is instantly released in a limited space by opening a pressure release valve, such that great thrust is generated to push the projectile body of the thrower to eject. However, such a thrower is mainly thrown artificially, and whether a throwing effect is ideal greatly depends on a throwing level of a throwing person. Moreover, the throwing effect is also influenced by external factors, such as weather, or the like.

The conventional rescue thrower has the following disadvantages. (1) The throwing effect is excessively dependent on the technical level of the throwing person, and a non-professional person cannot directly use the thrower; (2) the throwing effect is easily influenced by external factors, such as a temperature, humidity, a wind speed, or the like, during the throwing operation; and (3) after the throwing projectile body is ejected, a track and a fall point of the projectile body cannot be corrected and changed, and therefore, the instantly-changing dangerous case cannot be dealt with in time.

SUMMARY

In order to overcome the disadvantages of the prior art described above, the present disclosure provides an intelligent multi-rotor lifesaving thrower which has a plurality of rotors, and may precisely identify a fall point, and may adjust a position and posture of a throwing projectile body by the rotors to achieve a precise landing purpose. The present disclosure is suitable for various scenarios for which a conventional rescue thrower is suitable and some special scenarios where the conventional rescue thrower is insufficient. The present disclosure has advantages of a simple operation, small external interference, a long effective throwing distance, and an ideal effect.

A technical solution of the present disclosure includes the following. A thrower structure with rotors is provided, including a throwing projectile head (1), a projectile body shell (2), connecting flanges (3), three rotors (4), motors (5), a first splitter plate (6), a second splitter plate (7), a third splitter plate (8), a flight control module (9), a visual module (10), a laser radar (11), a battery (12), and a parachute storage bin (13), where the throwing projectile head (1) is located at a foremost end of a thrower and configured for breaking wind and reducing a resistance in an ascending process of the thrower, the parachute storage bin (13) is mounted at a center of a front end of the throwing projectile head (1), a rear end of the throwing projectile head (1) is connected to the projectile body shell (2) through threads, and the first splitter plate (6), the second splitter plate (7), and the third splitter plate (8) are directly connected to the projectile body shell (2) through slide grooves built in the projectile body shell (2) to equally divide a space in a cavity of the projectile body shell (2); the connecting flanges (3) tightly connect the projectile body shell (2) to the motors (5), each of the rotors (4) is connected to an upper end of a respective one of the motors (5), and the rotors (4) are provided in the space in the cavity of the projectile body shell (2) and separated from each other by the first splitter plate (6), the second splitter plate (7), and the third splitter plate (8), to provide a power for a system; the thrower structure is also provided with the flight control module (9), as well as the visual module (10), the laser radar (11), and the battery (12) which are connected to the flight control module (9);

the flight control module (9) is configured to read data of an accelerometer, a gyroscope, a magnetometer, a barometer, and the visual module in real time, fuse the data through Kalman filtering or graph optimization, estimate a speed, a posture, a position, and a surrounding environment of the thrower in real time, form an anti-interference control feedback using various data information obtained by the estimation and the fusion, and control the motors to realize an expected posture, speed, and position.

Further, the rotors (4) are at 120 degrees relative to each other to form an equilateral triangle shape and are mounted outwards.

Further, the flight control module (9), the visual module (10), and the laser radar (11) are mounted at a center of a bottom end of the projectile body shell and respectively located between adjacent ones of the first splitter plate (6), the second splitter plate (7), and the third splitter plate (8).

Further, the battery (12) is mounted in a gap at a connection position of the first splitter plate (6), the second splitter plate (7), and the third splitter plate (8).

The present disclosure provides a control method of the thrower structure with the rotors, including the following steps:

in a throwing process, totally arranging a main parachute in the parachute storage bin (13), arranging an auxiliary parachute outside the parachute storage bin to cover the throwing projectile head (1), an interior of the parachute storage bin (13) being divided into three spaces which are not communicated with each other and have equal volumes by the first splitter plate (6), the second splitter plate (7), and the third splitter plate (8), air entering the cavity from a bottom and being discharged by the rotors (4) in a falling process of the thrower, the air exerting an acting force on the thrower when being discharged to push the thrower to move in an opposite direction to wind, and adjusting counteracting force borne by the thrower via changing rotating speeds of the motors, so as to control a position and posture; and in the falling process, a gravity center of the thrower being mainly distributed on an air inlet side of the first splitter plate (6), the second splitter plate (7), and the third splitter plate (8), i.e., a side where the visual module and the laser radar are mounted, so that the thrower falling downwards with the side as a bottom, and the auxiliary parachute being firstly stressed to drag the main parachute out of the parachute storage bin, so as to reduce a falling speed of the thrower; meanwhile, the flight control module (9), the visual module (10), and the laser radar (11) starting to work, wherein the flight control module (9) estimates the posture of the thrower and adjusts the rotating speeds of the motors (5) to guarantee a stable-posture fall, the visual module (10) identifies and positions a fall point, and transmits information to the flight control module (9), the laser radar (11) monitors height data of the thrower in real time and feeds back the height data in real time, and a processor calculates a current position of the thrower relative to the fall point by acquiring the information, and controls the rotating speeds of the motors (5) in real time, such that a falling track of the thrower approaches the fall point to realize fall point tracking.

In conclusion, the present disclosure provides the multi-rotor intelligent thrower having a simple operation, small external interference, and an ideal throwing effect.

In the thrower, the parachute and the rotors 4 are combined to prolong airborne time of the thrower, such that the flight control module 9 has enough time to make judgment and response, and adjusts the rotating speeds of the motors 5 to achieve track change and fall point tracking purposes. Multi-sensor fusion realizes state estimation of the thrower, and then, stable falling flight of the thrower is realized with a control algorithm. A target is identified and tracked by the laser radar 11 and the visual module 10, and the onboard processor makes control response by receiving signals, such that the multi-rotor intelligent thrower is thrown accurately.

Compared with a conventional rescue thrower, the method according to the present disclosure has the following advantages.

(1) A unique structure of the thrower incorporating the parachute greatly increases the airborne time of the thrower, such that sufficient response time is provided for the flight control module to analyze and track a throwing point.

(2) Specific structural design reduces energy loss, such that utilization of wind energy by the thrower is nearly maximized. A whole power part of the thrower only consists of three rotor motors configured to adjust the track, and power configured for reducing the falling speed in the falling process is provided by wind power.

(3) Under a premise that falling time is prolonged greatly, the flight control module controls the rotor motors, and the fall point is changed by adjusting the falling track, so as to achieve the fall point tracking purpose.

(4) A combination of carbon fibers and aviation aluminum parts is adopted in the design, and self-weight is small.

BRIEF DESCRIPTION OF THE DRAWINGS

In FIG. 1 to FIG. 3, 1—throwing projectile head; 2—projectile body shell; 3—connecting flange; 4—rotor; 5—motor; 6—first splitter plate; 7—second splitter plate; 8—third splitter plate; 9—flight control module; 10—visual module; 11—laser radar; 12—battery; 13—parachute storage bin.

DETAILED DESCRIPTION OF THE EMBODIMENTS

Figure 1:
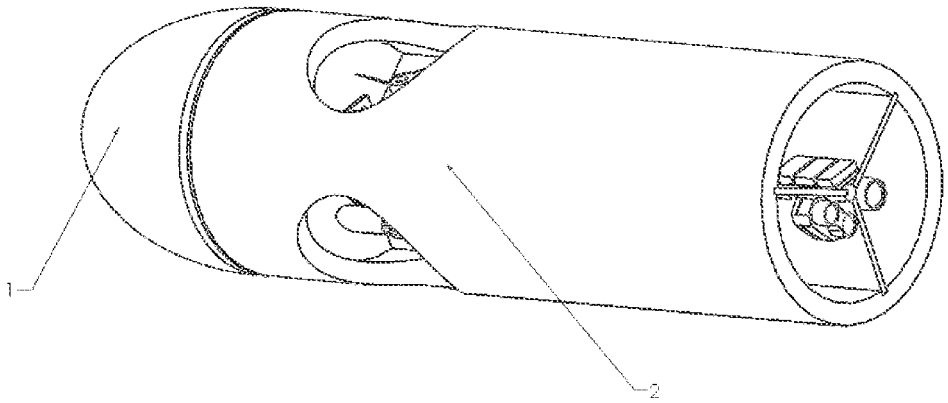
FIG. 1 is a schematic diagram of a basic structure according to the present disclosure.

The present disclosure is further described below with reference to the accompanying drawings and examples.

A thrower structure with rotors includes a throwing projectile head 1, a projectile body shell 2, connecting flanges 3, the rotors 4, motors 5, a first splitter plate 6, a second splitter plate 7, a third splitter plate 8, a flight control module 9, a visual module 10, a laser radar 11, a battery 12, and a parachute storage bin 13. A thrower includes three rotors 4 which are all arranged in a thrower bin, and the three rotors are at 120 degrees relative to each other to form an equilateral triangle shape and are mounted outwards. The three rotors are not configured to provide lifting force during rise, and are only required to provide lateral force to change a position and posture of the thrower in a falling process after the thrower reaches a highest point, such that a fall point is positioned accurately, and therefore, the rotors are not required to generate too much power; that is, motor power corresponding to each of the rotors is relatively low, and common low-power motors with low price may be selected, thus reducing quality of the thrower while improving universality and economic benefits.

FIG. 1 shows a schematic diagram of a basic structure of an intelligent multi-rotor thrower, and an external portion of the intelligent multi-rotor thrower mainly includes the following two parts: 1—throwing projectile head and 2—projectile body shell; in a rising process, the throwing projectile head 1 breaks the wind and reduces the resistance for the thrower, and a projectile body plays a role of supporting the whole thrower and is a carrier and a protective shell internally provided with modules.

Figure 2:
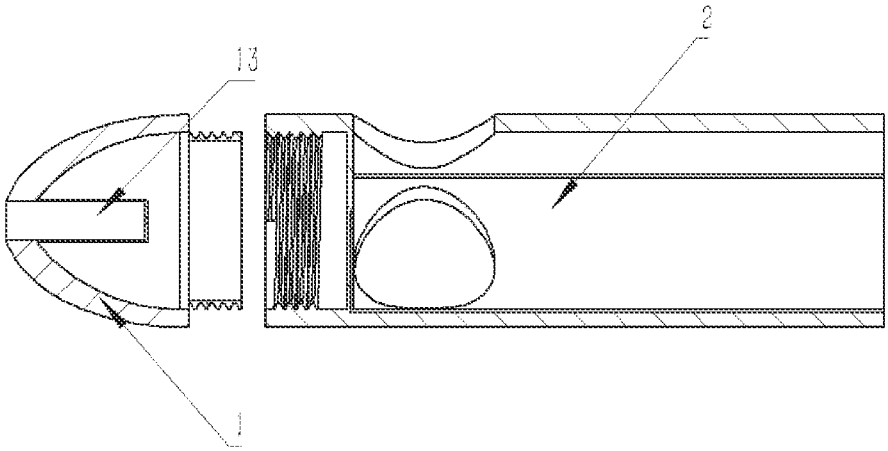
FIG. 2 is a cross-sectional view of an external structure according to the present disclosure.

FIG. 2 shows a cross-sectional view of an external structure of the intelligent multi-rotor thrower, which mainly includes the following parts: 1—throwing projectile head, 2—projectile body shell, and 13—parachute storage bin; the parachute storage bin 13 is mounted at a center of a front end of the throwing projectile head 1, and a rear end of the throwing projectile head 1 is connected to the projectile body shell 2 through threads.

Figure 3:
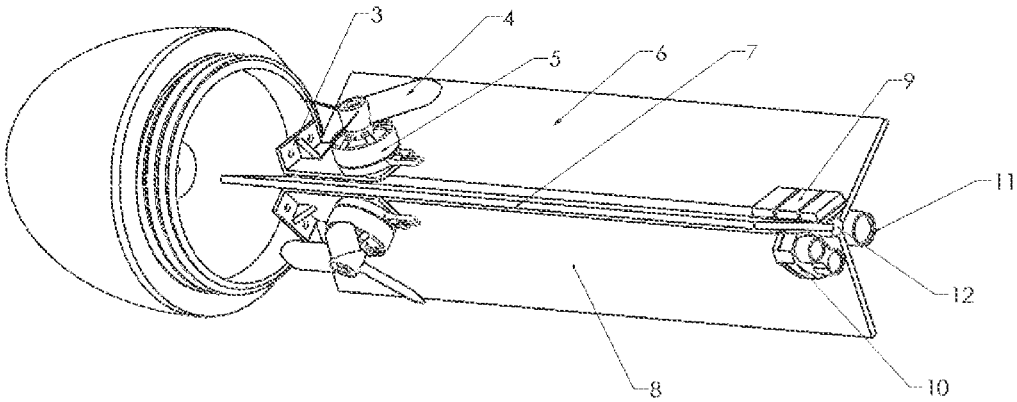
FIG. 3 is a schematic diagram of an internal structure according to the present disclosure.

FIG. 3 shows a schematic diagram of an internal structure of the intelligent multi-rotor thrower, which mainly includes the following parts: 3—connecting flange, 4—rotor, 5—motor, 6—first splitter plate, 7—second splitter plate, 8—third splitter plate, 9—flight control module, 10—visual module, 11—laser radar, 12—battery, and 13—parachute storage bin. In the whole structure, the three rotors 4 are mounted concentrically with circular grooves formed in side surfaces. A large parachute is arranged in the parachute storage bin 13, and a small parachute is arranged outside the parachute storage bin to wrap a projectile head. The flight control module 9, the visual module 10, the laser radar 11, or the like, have low mounting precision requirements, and mounting ways of the flight control module, the visual module, and the laser radar may be changed correspondingly according to actual operational requirements.

The flight control module 9 reads data of an accelerometer, a gyroscope, a magnetometer, a barometer, and the visual module in real time, fuses the data through Kalman filtering or graph optimization, estimates a speed (speeds in X, Y, and Z axes), posture (roll angle, pitch angle, and yaw angle), position (coordinates in X, Y, and Z axes), and surrounding environment of the thrower in real time, forms anti-interference control feedback using various data information obtained by the estimation and the fusion, and controls the motors to realize an expected posture, speed, and position.

Figure 4:
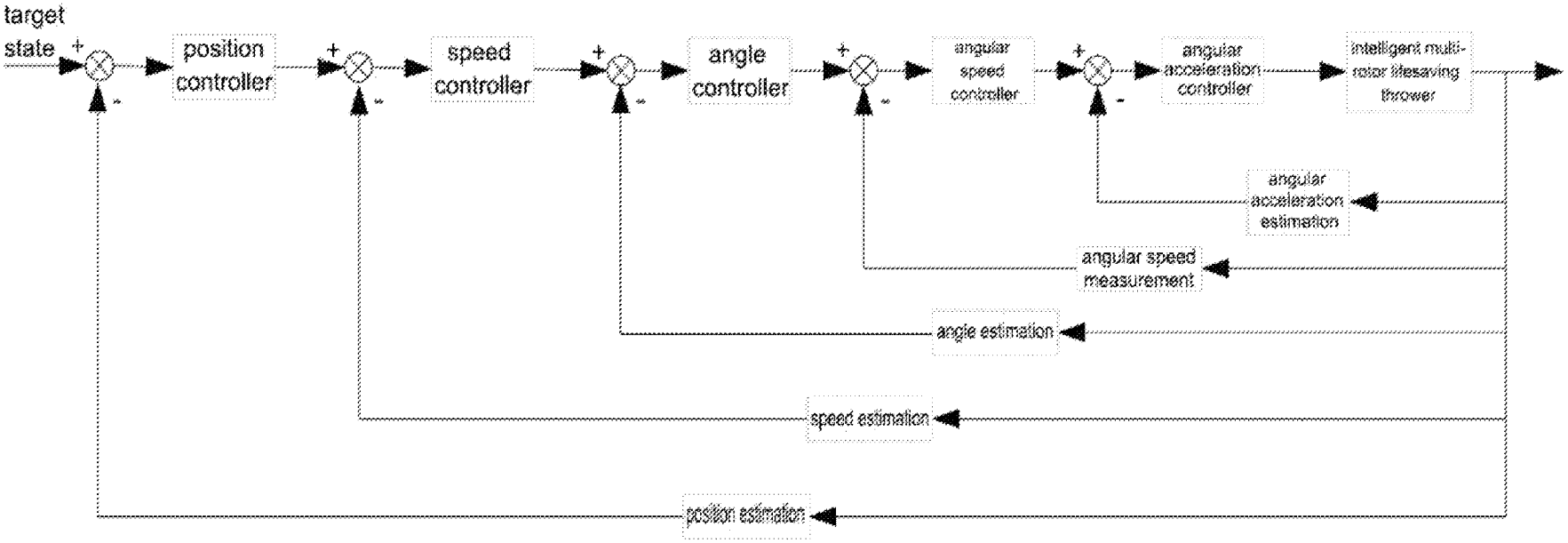
FIG. 4 is a block diagram of a control algorithm according to the present disclosure.

FIG. 4 shows a block diagram of a control algorithm according to the present disclosure. A plurality of flight parameters of the thrower are collected and processed in real time by various controllers, such as a position controller, a speed controller, an angle controller, an angular speed controller, an angular acceleration controller, or the like, and proportion-integration-differentiation (PID) cascade control is adopted to adjust a plurality of internal and external rings in parallel, thus enhancing the anti-interference performance of the system. Since the thrower is controlled by the plurality of controllers, more variables may be controlled compared with a single controller, thus making the thrower more adaptable.

The present disclosure provides a control method of the thrower structure with the rotors, including the following steps.

The throwing projectile head 1 is located at a foremost end of the thrower and configured for breaking the wind and reducing the resistance for the whole thrower in a throwing process. The throwing projectile head 1 has an ellipsoidal structure, the parachute storage bin 13 is provided at a center of a front end of the ellipsoid, and in the throwing process, a main parachute is totally arranged in the parachute storage bin 13, and an auxiliary parachute is arranged outside the parachute storage bin and covers the throwing projectile head 1; in the throwing rising process, the wind resistance acts backwards along the projectile head, such that the auxiliary parachute is attached to a surface of the projectile head without affecting a throwing track, and meanwhile may cover the parachute storage bin 13 to avoid that a throwing operation is affected due to air entering parachute storage grooves. An interior of the thrower bin is divided into three spaces which are not communicated with each other and have equal volumes by the first splitter plate 6, the second splitter plate 7, and the third splitter plate 8, air enters the cavity from a bottom and is discharged by the rotors 4 in a falling process of the thrower, and the air exerts acting force on the thrower when being discharged to push the thrower to move in an opposite direction to wind. That is, counteracting force borne by the thrower may be adjusted by changing rotating speeds of the motors, so as to control the position and posture.

In the falling process, since a gravity center of the thrower is mainly distributed on an air inlet side of the splitter plate, i.e., a side where a visual module and a laser radar are mounted, the thrower may fall downwards with this side as a bottom, and at this point, the small parachute is firstly stressed to drag the large parachute out of the parachute storage bin, so as to reduce a falling speed of the thrower; meanwhile, the flight control module 9, the visual module 10, and the laser radar 11 start to work, the flight control module 9 estimates the posture of the thrower and adjusts the rotating speeds of the motors 5 to guarantee a stable-posture fall, the visual module 10 identifies and positions a fall point, and transmits information to the flight control module 9, the laser radar 11 monitors height data of the thrower in real time and feeds back the height data in real time, and a processor calculates a current position of the thrower relative to the fall point by acquiring the information, and controls the rotating speeds of the motors 5 in real time, such that a falling track of the thrower approaches the fall point to realize fall point tracking.

What is claimed is:

1. A thrower structure with rotors, comprising a throwing projectile head, a projectile body shell, connecting flanges, three rotors, motors, a first splitter plate, a second splitter plate, a third splitter plate, a flight control module, a visual module, a laser radar, a battery, and a parachute storage bin, wherein the throwing projectile head is located at a foremost end of a thrower and configured for breaking a wind and reducing a resistance in an ascending process of the thrower, the parachute storage bin is mounted at a center of a front end of the throwing projectile head, a rear end of the throwing projectile head is connected to the projectile body shell through threads, and the first splitter plate, the second splitter plate, and the third splitter plate are directly connected to the projectile body shell through slide grooves built in the projectile body shell to equally divide a space in a cavity of the projectile body shell;

the connecting flanges tightly connect the projectile body shell to the motors, each of the rotors is connected to an upper end of a respective one of the motors, and the rotors are provided in the space in the cavity of the projectile body shell, evenly distributed along a circumference, and separated from each other by the first splitter plate, the second splitter plate, and the third splitter plate, to provide a power for a system; and the thrower structure is also provided with the flight control module, and the visual module, the laser radar, and the battery are connected to the flight control module.

2. The thrower structure with the rotors according to claim 1, wherein the flight control module is configured to read data of an accelerometer, a gyroscope, a magnetometer, a barometer, and the visual module in real time, fuse the data through Kalman filtering or graph optimization, estimate a speed, a posture, a position, and a surrounding environment of the thrower in real time, form an anti-interference control feedback using various data information obtained by the estimation and the fusion, and control the motors to realize an expected posture, speed, and position.

3. The thrower structure with the rotors according to claim 1, wherein the rotors are at 120 degrees relative to each other to form an equilateral triangle shape and are mounted outwards.

4. The thrower structure with the rotors according to claim 1, wherein the flight control module, the visual module, and the laser radar are mounted at a center of a bottom end of the projectile body shell and respectively located between adjacent ones of the first splitter plate, the second splitter plate, and the third splitter plate.

5. The thrower structure with the rotors according to claim 1, wherein the battery is mounted in a gap at a connection position of the first splitter plate, the second splitter plate, and the third splitter plate.

6. A control method of the thrower structure with the rotors according to claim 1, comprising the following steps:

in a throwing process, totally arranging a main parachute in the parachute storage bin, arranging an auxiliary parachute outside the parachute storage bin to cover the throwing projectile head, an interior of the parachute storage bin being divided into three spaces which are not communicated with each other and have equal volumes by the first splitter plate, the second splitter plate, and the third splitter plate, air entering the cavity from a bottom and being discharged by the rotors in a falling process of the thrower, the air exerting an acting force on the thrower when being discharged to push the thrower to move in an opposite direction to wind, and adjusting counter-acting force borne by the thrower via changing rotating speeds of the motors, so as to control a position and posture; and in the falling process, a gravity center of the thrower being mainly distributed on an air inlet side of the first splitter plate, the second splitter plate, and the third splitter plate wherein the visual module and the laser radar are mounted in the air inlet side, so that the thrower falling downwards with the air inlet side as a bottom, and the auxiliary parachute being firstly stressed to drag the main parachute out of the parachute storage bin, so as to reduce a falling speed of the thrower; meanwhile, the flight control module, the visual module, and the laser radar starting to work, wherein the flight control module estimates the posture of the thrower and adjusts the rotating speeds of the motors to guarantee a stable-posture fall, the visual module identifies and positions a fall point, and transmits information to the flight control module, the laser radar monitors height data of the thrower in real time and feeds back the height data in real time, and a processor calculates a current position of the thrower relative to the fall point by acquiring the information, and controls the rotating speeds of the motors in real time, such that a falling track of the thrower approaches the fall point to realize fall point tracking.

* * * * *